US006862824B1

(12) United States Patent
Hermanson et al.

(10) Patent No.: US 6,862,824 B1
(45) Date of Patent: Mar. 8, 2005

(54) ORNAMENTAL DISPLAY IN A BOTTLE

(75) Inventors: Terry Hermanson, New York, NY (US); Huang Meng-Suen, Kowloon (HK)

(73) Assignee: Mr. Christmas Inc., New York, NY (US)

( * ) Notice: Subject to any disclaimer, the term of this patent is extended or adjusted under 35 U.S.C. 154(b) by 0 days.

(21) Appl. No.: 10/327,183

(22) Filed: Dec. 24, 2002

(51) Int. Cl.[7] ..... G09F 19/12

(52) U.S. Cl. ..... 40/427; 40/414; 40/431; 40/442; 40/906; 40/455

(58) Field of Search ..... 40/414, 426, 427, 40/430, 431, 442, 310, 311, 906, 455

(56) References Cited

U.S. PATENT DOCUMENTS

| | | | | | |
|---|---|---|---|---|---|
| 5,018,288 | A | * | 5/1991 | Yang | 40/406 |
| 5,666,750 | A | * | 9/1997 | Segan et al. | 40/410 |
| 5,864,976 | A | * | 2/1999 | Yang | 40/410 |
| 5,984,492 | A | * | 11/1999 | Cha | 40/431 |
| 2002/0012689 | A1 | * | 1/2002 | Stillman | 424/439 |

* cited by examiner

*Primary Examiner*—Gary C. Hoge
(74) *Attorney, Agent, or Firm*—Fitzpatrick, Cella, Harper & Scinto

(57) ABSTRACT

An ornamental display assembly includes a display container having an opening at a first end. A closure member is provided and is movable between an open position, wherein the opening is unobstructed by the closure member, and a closed position, wherein the opening is blocked by the closure member. A decorative sculpture is displayed inside the container. An electronic apparatus is disposed in the container in operable communication with the closure member, such that when the closure member is in the open position the electronic apparatus is activated, and when the closure member is in the closed position the electronic apparatus is deactivated. The electronic apparatus is a music box, a lighting display, an electric motor, or any combination thereof. The ornamental display assembly further includes a magnetically operated switch for activation of the electronic apparatus, and a magnet located in the closure member. When the closure member is in the closed position, the magnet causes the switch to be in the open state and no electric is conducted through the switch. When the closure member is in the open position, the switch moves to a closed state and electric current is conducted through the switch to activate the electronic apparatus.

17 Claims, 3 Drawing Sheets

ORNAMENTAL DISPLAY IN A BOTTLE

BACKGROUND OF THE INVENTION

1. Field of the Invention

The present invention generally relates to an ornamental display assembly. In particular, the present invention relates to an ornamental display including an electronic apparatus, which is housed in a transparent display container, the electronic apparatus being activated in accordance with the position of a closure member of the display container.

2. Discussion of the Related Art

The proverbial ship-in-a-bottle is perhaps the most well-known type of ornamental display housed in a clear glass bottle. To help pass the long hours at sea, sailors often carved tiny ships in minute detail. Once the ship was completed, the miniature rigging and masts were folded down and the entire ship slipped through the neck of a discarded bottle. Once inside the bottle, the rigging and masts were carefully raised back into position using a piece of thread. The bottle was then typically sealed with a cork stopper and displayed on some sort of stand.

It is also known in the art to encase other sorts of ornamental displays within some sort of transparent housing or container. For example, snow globes having a scene depicted inside a glass or plastic globe, are common decorations during the holidays. These globes are typically filled with some sort of clear liquid and small white particles that are designed to resemble snow. When a user shakes the globe the white particles are dispersed in the liquid and appear to be snow falling down on the scene depicted in the globe. These snow globes often include a music box in the base portion that plays music appropriate for the given scene depicted, e.g., the song Jingle Bells for a scene of Santa and his reindeer.

Furthermore, jewelry boxes are known that play music when a lid is opened. Such jewelry boxes generally comprise a small wooden box with a music mechanism located in a bottom compartment. A small pin-driven actuator is located near the connection of the lid to the box, such that when the lid is closed, the pin is depressed to deactivate the actuator and hence the music mechanism. When the lid is lifted, the pin is raised allowing actuator to actuate the music mechanism to begin playing again. These jewelry boxes typically employ a windup music mechanism to generate the music.

Even given this state of the art, there is a constant need to develop new and different types of display devices that provide improved amusement and entertainment. The present invention provides such an improved device.

SUMMARY OF THE INVENTION

One object of the present invention is to provide an ornamental display assembly that is housed in a display container and includes an electronic apparatus that is activated in accordance with the position of a closure member with respect to the display container.

An ornamental display assembly according to the present invention comprises a display container (or bottle) having an opening at a first end. A closure member is provided and is movable between an open position, wherein the opening is unobstructed by the closure member, and a closed position, wherein the opening is blocked by the closure member. A decorative sculpture is displayed inside the container. An electronic apparatus is disposed in the container in operable communication with the closure member, such that when the closure member is in the open position the electronic apparatus is activated, and when the closure member is in the closed position the electronic apparatus is deactivated. The electronic apparatus of the present invention may be a music box, a lighting display, an electric motor, or any combination thereof.

The ornamental display assembly may further include a switch for activation of the electronic apparatus, located in proximity to the closure member when the closure member is in the closed position. Specifically, the switch comprises a first electrode and a second electrode, the first electrode being disposed closely adjacent the second electrode. Thus, when the closure member is in the closed position, the switch is in the open state and no electric current flows through the switch, and when the closure member is in the open position, the switch is in a closed state and electric current is allowed to flow through the switch to activate the electronic apparatus.

Moreover, the ornamental display assembly may include a magnet disposed in the closure member so as to be in proximity to the switch when the closure member is in the closed position. In this case, the first electrode is spring-biased toward the second electrode and is ferromagnetic, such that when the closure member is in the open position, the first electrode is spring-biased toward the second electrode and into the closed state. However, when the closure member is in the closed position, the magnet attracts the first electrode away from the second electrode and into the open state.

These and other objects, features, and advantages of the present invention will be apparent from the following description of the preferred embodiments, with reference to the following drawing.

DETAILED DESCRIPTION

Figure 1A:
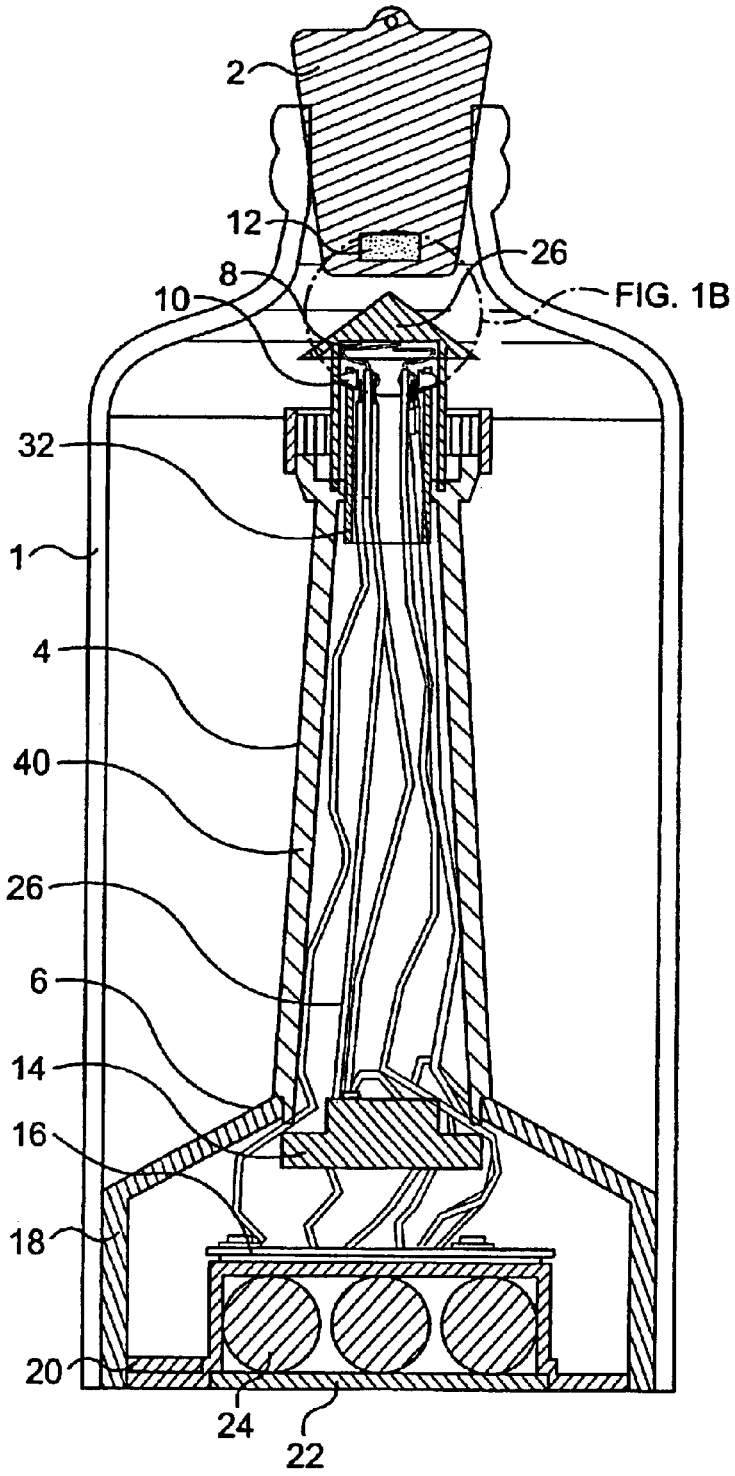
FIG. 1A is a vertical cross-sectional view of the ornamental display assembly according to a preferred embodiment of the present invention.

As shown generally in FIG. 1A, an ornamental display assembly according to the present invention comprises a decorative sculpture 4 and an electronic apparatus enclosed in a bottle 1, for display of the sculpture 4. The bottle 1 has an opening at its upper (first) end, and a closure member 2 is removably positioned in the opening. As will be described in greater detail below, the electronic apparatus may be a music box 6, a lighting display 32, an electric motor 34 for animation of the sculpture 4, or any combination of these devices.

The ornamental display assembly of the present invention may advantageously be placed on a desk, mantel, shelf, curio, cabinet, table, or other suitable display surface, and may be viewed from any side. The ornamental display assembly is shown in FIG. 1A in a closed or non-operating position, with the closure member 2 inserted in the opening in the top of the bottle 1. Removal of the closure member 2 from the opening activates the electronic apparatus to generate sound, motion, and or light, depending on the particular configuration of the electronic apparatus, thereby to enhance a user's viewing experience of the ornamental display assembly.

Figure 1B:
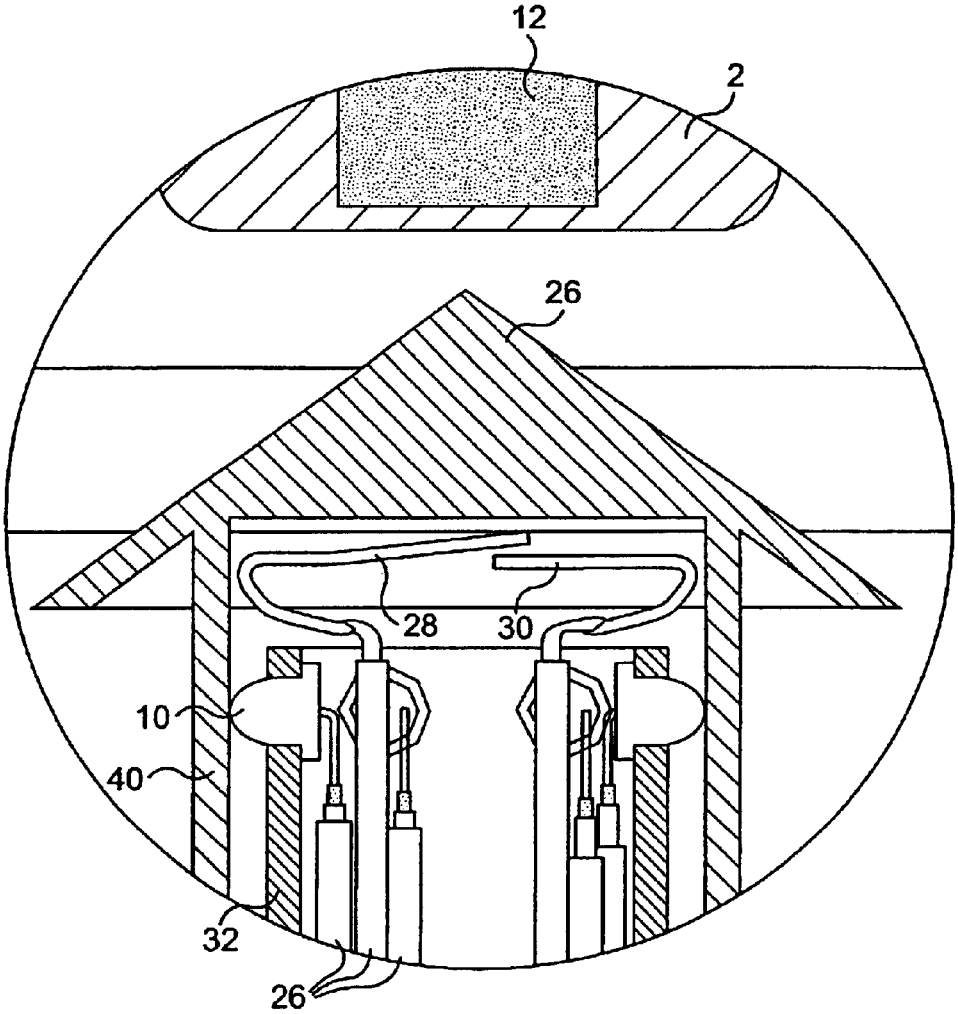
FIG. 1B is a vertical cross-sectional view showing an enlarged view of the switch of FIG. 1A.

As noted, in a preferred embodiment of the present invention, shown in FIGS. 1A and 1B, the ornamental display assembly of this embodiment comprises a bottle 1, a closure member 2 for selectively opening and closing the bottle 1, a sculpture 4 in the form of a lighthouse, and a music box 6. While the sculpture 4 is depicted in this embodiment as being a statue of a lighthouse, the invention is not limited to such a statue and may incorporate any desired sculpture, figurine, decoration, or the like.

The bottle 1 is preferably a glass bottle, which has a substantially cylindrical body portion sized to accommodate the sculpture 4 and the music box 6, and which narrows into a neck at the top of the body portion for receiving the closure member 2. While the bottle 1 is disclosed as being substantially cylindrical, the shape of the bottle 1 is not critical, and any size and shape of bottle that is capable of accommodating the sculpture may be used. Further, while the bottle is preferably made of glass for aesthetic purposes, other design or cost considerations may dictate that the bottle be made from plastic or other transparent materials. The only requirement for the material of the bottle 1 is that it be substantially transparent to enable effective viewing of the sculpture 4.

The closure member 2 is constructed as a tapered or conical stopper sized to be partially inserted into the neck portion of the bottle 1. The closure member 2 is preferably made of cork. However, other suitable materials, such as rubber, wood, plastic, metal, or combinations thereof, may also be used. A magnet 12 is affixed to or mounted in the lower portion of the closure member 2, so as to be in close proximity to the top of the sculpture 4 when the closure member is inserted in the neck of the bottle 1. The magnet 12 may be affixed to the closure member 2 by any suitable means. However, for aesthetic purposes, it is preferably disposed within an internal cavity of the closure member 2, so as to be hidden from view.

As described above, the sculpture 4 of this embodiment takes the shape of a lighthouse. The sculpture 4 is fixedly mounted at its base to the top of the music box 6 and includes a lighting display unit 32 mounted in the top portion thereof to simulate the lamp of a lighthouse. Further, the sculpture 4 has a switch 8 positioned in the upper most portion for activation of the music box 6 and the lighting display unit 32 in accordance with the position of the closure member 2. The lighting display unit 32 includes a plurality of lights 10 connected to a power source 24 by a plurality of wires 26.

As shown in FIG. 1B, which is an enlarged vertical cross-sectional view of the top portion of the sculpture 4 shown in FIG. 1A, the switch 8 comprises a first electrode 28 and a second electrode 30. The first electrode 28 is positioned closely adjacent the second electrode 28. The first electrode 28 is resiliently biased toward the second electrode 30 and, therefore, toward a closed position of the switch 8. The first electrode 28 is made of a ferromagnetic material, such that it is subject to magnetic attraction. When the closure member 2 is removed from the neck of the bottle 1 (i.e., the open position), the first electrode 28 of the switch 8 is resiliently biased into contact with the second electrode 30 (the closed state of the switch) and electricity is allowed to flow through the switch 8 to activate the music box 6 and the lighting display unit 32. When the closure member 2 is inserted in the neck of the bottle 1 (i.e., the closed position, shown in FIG. 1B), the magnet 12 is positioned close to the switch 8 and attracts the first electrode 28 and causes it to deflect away from the second electrode 30 (the open state of the switch), such that electricity is not allowed to flow through the switch 8 and the music box 6 and lighting display 32 are deactivated.

The second electrode 30 may be constructed of a non-ferromagnetic material such that the magnet 12 does not attract it. Alternatively, the second electrode may be made of the same material as the first electrode 28, but having a greater rigidity or may otherwise be secured or mounted in a fixed position, such that the second electrode 30 is also attracted by the magnet 12, but does not deflect sufficiently to close the switch.

The music box 6 of this embodiment, as shown in FIG. 1A, generally comprises a printed circuit board (PCB) 16 and a speaker 14 housed within a cavity formed in the under side of a base member 18. The music box 6 is inserted in a second opening of the bottle 1 located at the second end of the bottle, opposite the end having the closure member 2, and effectively forms the bottom surface of the bottle 1. The speaker 14 is mounted to the base member 18 directly below the sculpture 4. A bottom panel 20 is connected to the base member 18 and covers the bottom of the base member 18 to enclose the cavity in the underside of that base member 18. The PCB 16 is mounted to the top surface of the bottom cover 20 and is electrically connected to the speaker 14 and the switch 8 by wires 26. Thus, the music box 6 is self-contained and could optionally be inserted in the bottle 1 as a pre-assembled unit during manufacture of the ornamental display assembly. While the music box 6 is described as an electrically powered music box, it will be understood that other types of music box, such as a mechanical music box, could also be used in connection with the present invention.

A power source 24 is provided to supply power to the electronic apparatus of the ornamental display assembly, and is secured within a compartment in the bottom of the bottom panel 20 by a compartment cover 22. In this preferred embodiment, the power source is embodied as a number of conventional batteries. However, other power sources could also be used, such as, a battery pack, an AC adapter for connection to electricity from a wall socket, a solar cell, or any other suitable source of electric power.

The PCB 16 includes a memory (not shown), which contains previously stored data corresponding to music to be output by the speaker 14 of the ornamental display device upon activation. Specifically, when the switch 8 is closed, i.e., when the closure member 2 is removed, electricity is conducted from the power source 24 to the PCB 16. The PCB 16 then outputs the previously stored data from the memory to the speaker 14, to thereby output music from the speaker 14, as well as to activate the lighting display 32.

Figure 2:
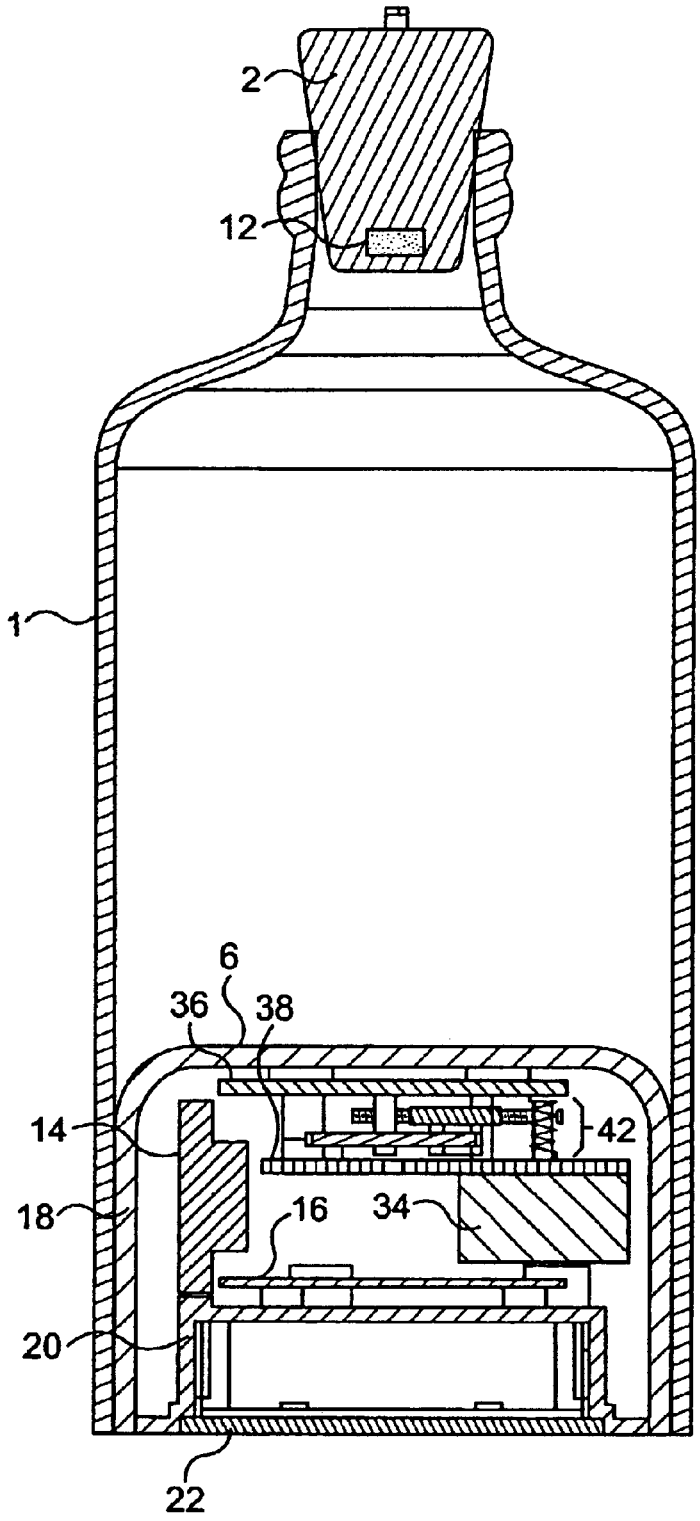
FIG. 2 is a partial vertical cross-sectional view of the ornamental display assembly depicting a variation of the ornamental display of the present invention having an electric motor.

As shown in FIG. 2, the ornamental display assembly may also include an electric motor 34 and a gear box 42 for animation of the sculpture. The details of the sculpture have been omitted in FIG. 2 for the sake of clarity. However, it will be understood that the switch 8 will activate the electric motor 34 in the same manner as the music box 6 and lighting display 32 described above. In such an animated ornamental display assembly, the electric motor 42 operates to animate the sculpture 4 for rotational, translational, and/or reciprocal motion within the bottle 1 upon activation of the assembly by removal of the closure member 2.

The gearbox 42 of the present invention is conventional. Furthermore, various different arrangements of the gearbox 42 may be appropriate depending on the type and extent of animation of the sculpture 4.

In FIG. 2, the speaker 14 is mounted horizontally in this latter embodiment to accommodate the electric motor 34. Of course the speaker 14, electric motor 34, and gear box 42 can all be arranged in any desired orientation, depending on the configuration of the ornamental display assembly.

While the present invention has been described as being activated upon opening of the closure member 2, it would also be possible to design the ornamental display assembly to be activated upon closing of the closure member and deactivated by opening of the closure member. Furthermore, while a magnetic switch is described, other types of switches could also be used to activate the ornamental display assembly, such as a pressure switch or the like.

Accordingly, while the present invention has been described with reference to certain preferred embodiments, it is to be understood that this description and accompanying drawings are not intended to limit the scope of the following claims.

What is claimed is:

1. An ornamental display assembly comprising:

a display container having an opening at a first end;

a closure member movable between an open position, wherein the opening is unobstructed by said closure member, and a closed position, wherein the opening is blocked by said closure member;

a decorative sculpture displayed inside said container; and an electronic apparatus disposed in said container in operable communication with said closure member, such that when said closure member is in one of the open position and the closed position said electronic apparatus is activated, and when said closure member is in the other of the open position and the closed position said electronic apparatus is deactivated.

2. An ornamental display assembly as set forth in claim 1, further comprising:

a switch for activation of said electronic apparatus, located in proximity to said closure member when said closure member is in said one of the open position and the closed position.

3. An ornamental display assembly as set forth in claim 2, wherein said switch comprises a first electrode and a second electrode, the first electrode being disposed adjacent said second electrode, such that when said closure member is in the closed position, said switch is in the open state and no electric current is conducted through said switch, and when said closure member is in the open position, said switch is in a closed state and electric current is conducted through said switch to activate said electronic apparatus.

4. An ornamental display assembly as set forth in claim 3, further comprising:

a magnet disposed in said closure member so as to be in proximity to said switch when said closure member is in the closed position, wherein said first electrode is spring-biased toward the second electrode and is ferromagnetic, such that when said closure member is in the open position, said first electrode is biased toward said second electrode to place the switch in the closed state, but when said closure member is in the closed position, said magnet attracts said first electrode away from said second electrode to place the switch in the open state.

5. An ornamental display assembly as set forth in claim 4, wherein said second contact is non-ferromagnetic.

6. An ornamental display assembly as set forth in claim 4, wherein said first electrode has a lower rigidity than said second electrode.

7. An ornamental display assembly as set forth in claim 4, wherein said second electrode is mounted so as to be substantially fixed regardless of whether said closure member is in the open position or the closed position.

8. An ornamental display assembly as set forth in claim 1, wherein said electronic apparatus comprises a music box, such that when said closure member is moved to the open position, the music box will be activated to play music, and when the closure member is in the closed position, the music box will be deactivated.

9. An ornamental display assembly as set forth in claim 1, wherein said electronic apparatus further comprises a lighting display disposed on said sculpture, such that when said closure member is moved to the open position, the lighting display will be activated to illuminate, and when the closure member is in the closed position, the lighting display will be deactivated.

10. An ornamental display assembly as set forth in claim 1, wherein said electronic apparatus comprises an electric motor for animating said sculpture, such that when said closure member is moved to the open position, the electric motor will be activated to animate said sculpture, and when the closure member is in the closed position, the electric motor will be deactivated.

11. An ornamental display assembly as set forth in claim 1, wherein said electronic apparatus comprises a lighting display disposed on said sculpture, such that when said closure member is moved to the open position, the lighting display will be activated to illuminate, and when the closure member is in the closed position, the lighting display will be deactivated.

12. An ornamental display assembly as set forth in claim 4, wherein said electronic apparatus comprises an electric motor for animating said sculpture, such that when said closure member is moved to the open position, the electric motor will be activated to animate said sculpture, and when the closure member is in the closed position, the electric motor will be deactivated.

13. An ornamental display assembly as set forth in claim 1, wherein said closure member is a stopper.

14. An ornamental display assembly as set forth in claim 1, wherein said container is made of plastic or glass.

15. An ornamental display assembly as set forth in claim 1, wherein the second end of said container, opposite the first end, has a second opening and said electronic apparatus is disposed in the second opening and forms a bottom surface of said container.

16. An ornamental display assembly as set forth in claim 1, wherein said sculpture is secured to the top surface of said electronic apparatus.

17. An ornamental display assembly comprising:

a display container having an opening at a first end;

a closure member movable between an open position, wherein the opening is unobstructed by said closure member, and a closed position, wherein the opening is blocked by said closure member, a decorative sculpture displayed inside said container;

an electronic apparatus disposed in said container in operable communication with said closure member, such that when said closure member is in the open position said electronic apparatus is activated, and when said closure member is in the closed position said electronic apparatus is deactivated;

a switch having a first electrode and a second electrode, the second electrode being disposed closely adjacent said first electrode;

a magnet disposed in said closure member so as to be in proximity to said switch when said closure member is in the closed position, wherein said first electrode is ferromagnetic, such that when said closure member is in the open position, said first electrode is biased toward said second electrode and into the closed state to activate said electronic apparatus, but when said closure member is in the closed position, said magnet attracts said first electrode away from said second electrode and into the open state to deactivate said electronic apparatus.

* * * * *